US006207601B1

(12) United States Patent
Maurer et al.

(10) Patent No.: US 6,207,601 B1
(45) Date of Patent: Mar. 27, 2001

(54) MELT-BLOWN NONWOVEN FABRIC, PROCESS FOR PRODUCING SAME AND THE USES THEREOF

(75) Inventors: Gunter Maurer, Neuenburg; Paul Rustemeyer; Eberhard Teufel, both of Gundelfingen, all of (DE)

(73) Assignee: Rhodia Acetow AG, Freiburg (DE)

( * ) Notice: Subject to any disclaimer, the term of this patent is extended or adjusted under 35 U.S.C. 154(b) by 0 days.

(21) Appl. No.: 09/077,044

(22) PCT Filed: Dec. 18, 1996

(86) PCT No.: PCT/EP96/05686

§ 371 Date: May 18, 1998

§ 102(e) Date: May 18, 1998

(87) PCT Pub. No.: WO97/33026

PCT Pub. Date: Sep. 12, 1997

(30) Foreign Application Priority Data

Mar. 8, 1996 (DE) ..... 196 09 143

(51) Int. Cl.[7] ..... D04H 5/04; D04H 3/16

(52) U.S. Cl. ..... 442/333; 442/327; 442/389; 442/400; 28/112; 156/167; 131/341; 428/401

(58) Field of Search ..... 442/322, 389, 442/400, 327, 373; 28/112; 156/167; 131/341; 428/401

(56) References Cited

U.S. PATENT DOCUMENTS 5,495,860 * 3/1996 Teufel et al. ..... 131/331
5,509,430 * 4/1996 Berger ..... 131/341

* cited by examiner

*Primary Examiner*—Blaine Copenheaver
*Assistant Examiner*—John J. Guarriello
(74) *Attorney, Agent, or Firm*—Buckman and Archer

(57) ABSTRACT

The disclosure relates to a melt-blown non-woven fabric based on cellulose esters, with fibers of mean diameter less than about 10 microns. The fabric contains 0–10 wt. % extractable softener, has a reflection factor determined according to DIN 53 145 Part I (1992) of more than 60% and the cellulose ester has a degree of substitution DS of about 1.5–3.0. The softener is preferably water-extractable. A melt-blown non-woven fabric is produced with the cellulose ester as follows: a cellulose ester, cellulose acetate, with a DS of about 1.5–3.0, in particular 1.7–2.7, is mixed with softener in a weight ratio of about 2:1 to 1:4 and simultaneously heated and melted. The mixture of softener and cellulose ester has a melting index MFI (210/2.16) according to DIN 53 735 of about 400 to 5 g/10 min., in particular 300 to 50 g/10 min. The melt is worked in a melt-blown spinning device into a melt-blown non-woven fabric and the softener is then extracted with a softener solvent to leave a proportion of 0–10 wt. %. The melt-blown non-woven fabric is especially suitable as a filter material.

27 Claims, No Drawings

MELT-BLOWN NONWOVEN FABRIC, PROCESS FOR PRODUCING SAME AND THE USES THEREOF

FIELD OF THE INVENTION

The invention relates to a melt-blown formed fabric based on cellulose esters, in particular on cellulose acetate, with fibers of an average fiber diameter of less than approximately 10 $\mu$m, a process especially suited for its production as well as advantageous applications of the melt-blown formed fabric.

BACKGROUND OF THE PRIOR ART

Melt-blown formed fabrics meet the ISO definition for formed fabric materials (ISO 9092:1988). According to it, a material is referred to as a formed fabric material if a) the fiber fraction is more than 50% by weight (except chemically broken down plant fibers) and the fibers have a coefficient of fineness greater than 300 or b) the following conditions are met: 1) the fiber fraction is more than 30% by weight (except chemically broken down plant fibers) and the fibers have a coefficient of fineness greater than 300 and 2) the density is less than 0.40 g/cm$^3$.

This ISO regulation is also observed by the formed fabrics explained in further detail in the following, with these being produced according to the melt-blown process or a melt-blown technique. Without wishing to see this as a restriction, the melt-blown process can be described as follows: i.e. the melt-blown filaments, fibers and formed fabrics are generally produced as follows:

The particular synthetic material is placed into an extruder in which it is melted. From the extruder the melt is moved into the spinning head which comprises the melt-blown spinneret, which is the central component of the process. Here the melt is brought to the required processing temperature. The nozzle itself comprises a number of capillary bores. On both sides of the nozzle bores are disposed openings for the primary process air which is under pressure. Below the nozzle is a stacking arrangement in the form of a driven traveling screen or a revolving screen through which the fibers are drawn in and stacked to form a formed fabric.

As the melt exits from the nozzle bores, it comes into contact with relaxing hot primary process air at high speed. In the process the melt of each capillary bore is torn apart and drawn into a large number of fine fibers. In this process the filaments largely are torn to form fibers. This is in contrast to other spin formed fabric processes in which fiber breaks must be prevented. Through the primary process air stream cold ambient air, referred to as secondary air, is drawn in and conducted to the fibers and filaments being formed. The generated filaments and fibers are consequently cooled directly under the spinneret. The fibers are subsequently stacked on the above cited stacking arrangement to form a formed fabric and are wound. Melt bonding between the fibers, as a rule, does not take place. The fiber lengths are, as a rule, of the order of magnitude of 5 to 50 cm. The fiber diameter is very small and, for example in connection with the invention described in the following, is less than approximately 10 $\mu$m.

Further information about the melt-blown process can be found in U.S. Pat. No. 3,825,379 (Exxon Research and Engineering Co.) as well as U.S. Pat. No. 4,714,647 (Kimberly Clark Corp.).

U.S. Pat. No. 4,869,275 also addresses the melt-blown process for the production of a formed fabric from various starting materials. As suitable starting materials are cited polyolefins (polypropylene, polyethylene and ethylene/propylene copolymers), polystyrene, polyester (polyethylene terephthalate), Nylon (6, 66 and 610), polymethylene methacrylates and generally also cellulose acetate. This patent does not specify the degree of substitution of this cellulose acetate when used in the described process. The unusual reference that <u>even</u> cellulose acetate is suitable ("even cellulose acetate" s. column 5, paragraph 1) indicates that it is only conditionally suitable. This is also in agreement with the technical findings that the narrow temperature interval between melting temperature and decomposition range largely excludes the conversion of the cellulose ester into processable melts, for example in the case of cellulose triacetate, and, in the case of lower melting cellulose acetopropionates, is still connected to incipient product damage (cf. Kunststoff-handbuch 3/1 Hansa Verlag, 1992, p. 411). If, in fact, cellulose acetate were processed into a melt-blown formed fabric at a high "melt temperature" which must be assumed, an undesirable strong degradation would occur. The degradation products would have a strong disadvantageous effect in various applications, thus in particular also when used as filter materials in tobacco smoke filters. Precisely this application is emphasized in U.S. Pat. No. 4,869,275. However, in the description of the especially practical embodiments, cellulose acetate is not taken into consideration. Due to the decomposition of cellulose acetate, which must be anticipated according to the known process, the quality of the obtained melt-blown formed fabric would also be impaired because no satisfactory degree of whiteness develops. In view of the decomposition of cellulose acetates at relatively high temperature, it should be pointed out that, beginning at 180° C., a marked chemical decomposition occurs which can be detected inter alia through the formation of furfural.

According to Example 5 of U.S. Pat. No. 3,509,009 a portion of the cellulose acetate and a portion of diethylphthalate (as softening agent) are melt-spun at a temperature of 170° C., so that decomposition of the cellulose ester used is largely excluded, but the product properties are dominated in an undesirable way by the softening agent. Such high content of softening agent restricts the application properties to the effect that too low a melting point is set as well as softening agent migration or exudation and exhalation can occur.

SUMMARY OF THE INVENTION

On the basis of the above described prior art, the invention is based on the object of further developing a melt-blown formed fabric of the above cited type such that it is not thermoplastic up to a temperature of approximately 180° C., has a desirably high reflection factor or degree of whiteness and, if desired, can be used for advantageous filter materials, in particular for filter materials of cigarettes and for the filtration of gases or fluids, in particular of blood. Moreover, the invention describes an especially advantageous process for the production of such melt-blown formed fabric.

According to the invention this object is achieved when the fabric comprises approximately 0 to 10 percent by weight of an extractable softening agent, has a reflection factor (R∞), determined according to DIN 53 145 Part 1 (1992), of more than approximately 60% and the cellulose ester has a degree of substitution DS of approximately 1.5 to 3.0.

The invention thus provides access to melt-blown formed fabrics comprising cellulose ester, which comprise little or even no softening agent, which previously could not have been considered to be possible.

The melt-blown formed fabric according to the invention comprises fibers of cellulose esters. These can be, for example, cellulose acetate, cellulose acetobutyrate, acetopropionate and propionate and the like. Preferred is cellulose acetate.

The degree of substitution DS of the cellulose ester used according to the invention is between approximately 1.5 to 3.0, in particular between approximately 1.7 to 2.7, wherein the range from approximately 2.2 to 2.6 is especially highly preferred. If the value falls to less than 1.5, damage of the polymer skeleton through dehydration must be anticipated. The targeted goals can also be attained with a degree of substitution of approximately 3.0, however, at this value undesirable crystallization and phase separation can occur. These undesirable drawbacks can be counteracted with a higher content of extractable softening agent up to approximately 10 wt %, however, if a lower softening agent content is targeted, it is advantageous to lower simultaneously the degree of substitution DS to at least approximately 2.7, in particular at least approximately 2.6.

In spite of the unusually good degree of whiteness, which will be discussed further, the melt-blown formed fabric according to the invention contains only up to approximately 10 wt. %, in particular approximately 2 to 8 wt. %, of an extractable softening agent, in particular in the form of a water-extractable softening agents. Consequently, the invention takes into account the relevant application purposes in which the fraction of softening agent cannot be too high since the product otherwise would be dominated in an undesirable way by the softening agent. Rather, the product properties should largely derive from the cellulose ester. The precise adjustment of the softening agent content within the specified framework of approximately 0 to 10 wt. % depends on the particular application of the formed fabric. Accordingly, it is left to the discretion of the expert to optimize the softening agent content quantitatively in individual cases within the scope of the invention. It has been found in using the melt-blown formed fabric in filter cigarettes to be desirable to adjust a softening agent content of approximately 5 to 10 wt. %, in particular when as the softening agent triacetin is used. It is known, for example, that triacetin affects positively the taste of the tobacco smoke and the specific retentions of cellulose acetate. A content of softening agent exceeding 10 wt. % would restrict the application to the effect that too low a melting point would occur as well as softening agent migration or exudation and exhalation and, in addition, undesirable adhesion. Furthermore, in the event of its use in filter sticks a high softening agent content would have a negative effect on the hardness of the filter sticks. In applications subject to food law regulations the softening agent content is kept as low as possible within the scope of the invention, in particular to nearly 0. The same applies for medical applications, such as for example in blood filters.

The softening agent used within the scope of the invention not only needs to develop a plastification effect. But, the softening agent, at the end of the production process must be present in a content above 10 wt. %, must be extractable from the melt-blown formed fabric with a suitable solvent such that the object of the invention of approximately 0 to 10 wt. % is set. In terms of their chemical and physical structure the cellulose ester fibers are to be largely unchanged in the process. As softening agent have proven to be suitable triacetin, ethylene and propylene carbonate, triethyl citrate, triethylene glycol diacetate, Carbowax® (polyethylene glycols of a molecular weight of 200 to 14000, produced by UCC, USA) and/or sulfolane (tetrahydrothiophene-1,1-dioxide). Triacetin is used with particular advantage since it can be extracted rapidly and effectively with water.

The degree of polymerization DP of the cellulose esters, in particular of the cellulose acetate, is not critical and can be within a relatively wide range. However, special advantageous results are attained if it is between 150 to 400, in particular between approximately 180 to 350. If the degree of polymerization falls below approximately 150, a too high fraction of oligomers would is present such that during the extraction of the softening agent, a large portion of the cellulose ester would simultaneously be extracted. If the upper limit value of approximately 400 is exceeded, the melt index in the melt-blow process described hereinbelow becomes too high which would have a disadvantageous effect on the process. In individual cases this problem could be reduced by raising the content of the softening agent, but this would mean additional expenditures in practicing the invention, in particular in connection with the removal or recovery of the softening agent.

Within the scope of the invention in view of the various fields in which the melt-blown formed fabric according to the invention can be used, of critical importance is a minimum reflection factor, also called degree of whiteness, of the formed fabric. The reflection factor or the degree of whiteness is measured according to DIN 53 145 Part I (1992) corresponding to ISO 2469 (1977). Herein an Elrepho device by Zeifs is used. A formed fabric sample folded in 8 layers one on top of the other is therein diffusely illuminated with an Ulbricht globe and measured perpendicularly to the sample plane (measurement geometry d/0) at 457 nm (by means of spectral band filters). Reference is here to the barium sulfate whiteness standard. The reflection factor or whiteness within the scope of the invention is more than 60%, in particular more than 70% or even approximately 90%. The whiteness is in particular a measure of the purity of the product according to the invention. If this were brownish or yellowish, this would mean that during the production undesirable and non-controllable decomposition products had been formed. For this reason the consumer would reject such product in the event of usage in the cigarette manufacturing industry. The disadvantage of an unsatisfactory whiteness degree can surprisingly also not be remedied by working in white pigments, such as titanium dioxide, during the production process. It is consequently an especially clear indication of the chemical purity of the cellulose ester fibers. This view point plays a predominant role in various areas, for example, when using the formed fabric in the biomedical field, in particular in blood filtration.

It can in individual cases be of advantage that the cellulose acetate is present in the form of a polymer blend, in particular with aliphatic polyesters and/or acetylated starches. In this case not only the desired properties can be optimized, such as for example the biological degradability in connection with aliphatic polyesters (cf. in this connection DE-C 39 14 022) but, beyond that, the feasibility of saving costs. This is evident in another application area from EP-A 0 622 407 to which reference will be made.

In order to attain the effects desired with the invention, the fiber diameter, such as is obtained in general according to the melt-blown process, must be less than approximately 10 $\mu$m, in particular between approximately 2 to 8 $\mu$m. The standard diameter of a filament obtained according to the dry-spin process, in contrast, is between approximately 15 and 40 $\mu$m. Fibers having a smaller diameter have the advantage that they have a greater specific surface and thus yield also greater activity in the desired application fields, in particular in filtration. Within the scope of the invention fibers of an average fiber diameter of less than approximately 8 μm can readily be adjusted. The especially advantageous practical range is between approximately 5 and 8 μm. The fiber diameter is the mean diameter. Here a number of fibers are measured using a scanning electron microscope and subsequently the mean value is formed.

In principle, if desired, to the melt obtained after the melt-blown process according to the invention to be described hereinbelow, active substances can be added, such as for example agriculturally active substances, pharmacologically active agents, selective and other filtration aids, for example for the selective retention, aroma substances, additives for biological degradability, etc. They are preferably melt-compatible.

The melt-blown formed fabric according to the invention can advantageously be produced when a cellulose ester, in particular cellulose acetate, of a degree of substitution of approximately 1.5 to 3.0, in particular of approximately 1.7 to 2.7, is mixed with a softening agent at a ratio by weight of approximately 2:1 to 1:4 while the mixture is being heated and converted to a melt, and the mixture of softening agent and cellulose ester has a melt index MFI (210/2.16) according to DIN 53 735 of approximately 400 to 5 g/10 min, in particular 300 to 50 g/10 min, the melt is processed in a melt-blown spinning device to form a melt-blown formed fabric and subsequently the softening agent is extracted with a solvent in which the softening agent is soluble such that a fraction of approximately 0 to 10 wt. % remains. In order to convert the starting materials into a melt, they are preferably heated to a temperature of more than approximately 100° C. The especially suitable melt temperature depends on the individual case and can be determined by an expert solely conventionally. However, a temperature of 240° C. should not be exceeded since otherwise undesired decomposition phenomena would occur.

The melt-blown formed fabric obtained according to the invention comprises, as shown, a low fraction of extractable softening agent of approximately 0 to 10 wt. %. Due to the way in which the process is conducted the decomposition of the cellulose ester used is largely eliminated. It is not required that work be carried out in a protective atmosphere to avoid undesirable oxidative processes. It is of advantage if the melt is subjected to the melt-blown process immediately after its production, since otherwise undesired degradation reactions can occur. Thus, a special advantage of the process according to the invention lies that it can be carried out continuously. Thus, the mixing and the spinning advantageously take place in a single process step so that the mixture from the extruder is supplied immediately to the melt-blown spinneret. The process according to the invention consequently represents a marked simplification with respect to the carrying-out of the process.

For carrying out the melt-blown process according to the invention it is advantageous if the ratio by weight of softening agent to cellulose ester is adjusted to approximately 3:2 to 2:3, consequently in the practical embodiment preferably to approximately 1:1, which also corresponds to the demands of U.S. Pat. No. 3,509,009. However, the present invention differs in the process from the teaching according to U.S. Pat. No. 3,509,009 because it absolutely requires the use of a suitable solvent for the softening agent. Accordingly, a solvent for the extraction of the softening agent is used according to the invention, which however, does not impair the chemical and physical structure of the cellulose ester fibers.

The type of mixing of softening agent and cellulose esters, optionally with further additives, is not subject to significant restrictions. It has been found that the mixing of cellulose ester and softening agent is carried out especially advantageously in a twin-screw extruder. The shear necessary for optimum mixing of the starting materials is attained which leads to an especially advantageous homogenation of the starting material. It is preferred to use a parallel twin-screw extruder.

The process according to the invention is controlled especially advantageously in the melt-blown spinning device if at the spinneret and the spinning head of the spinning device a temperature of approximately 180° to 240° C., in particular of approximately 200 to 230° C. is kept. If the temperature is lower than approximately 180° C., the result can be an insufficient fineness of the product of the process. If the upper limit of 240° C. is exceeded, undesirable degradation occurs.

The softening agents usable within the scope of the invention have already been discussed earlier, in particular the advantageous use of the water-extractable softening agents in the form of triacetin. In the case of a water-extractable softening agent, the obtained melt-blown formed fabric is simply conducted into a water bath for the extraction of the softening agent. The process according to the invention can here be carried out with the special advantage that a normal water bath (approximately ambient temperature), i.e. without heating, can be used for the extraction. In the presence of high softening agent content, the application of a hot extracting bath is even of disadvantage since the melt-blown formed fabric in this case has a melting range such that its structure is impaired or even destroyed.

It is especially advantageous if the formed fabric leaving the melt-blown spinning device is transferred to a stacking arrangement, in particular in the form of a screen or traveling screen or revolving screen, pressed to adjust the desired thickness, and subsequently the softening agent is extracted. It is in principle also possible to carry out the extraction before the molding. If desired, the melt-blown formed fabric can also be structured during the molding. The structuring takes place in order to obtain the structure advantageous for the later use, for example in the case of its use in cigarette filters, longitudinal fluting, in connection with surface enlargement.

Lastly, it can in individual cases be advantageous to incorporate in the formation of the melt-blown formed fabric simultaneously filaments, in particular cellulose acetate filaments. Two options described in detail in DE 35 21 221 exist in principle. In this respect reference is expressly made to them. In general the incorporation of filaments leads to an improvement of the mechanical properties, in particular of the tensile strength of the material.

It is also of special advantage if the melt-blown formed fabric leaving the spinning device is deposited onto filter tow processed so as to be flat or on paper for the formation of a compound structure on a base, in particular in the form of a formed fabric comprising a cellulose acetate filter tow. In the event a base of formed fabric is used, the expert, depending on the intended end use, can determine the formed fabric suitable in each case without any problems. For example, in the case of the further use of the melt-blown formed fabric according to the invention in filter cigarettes, preferably a cellulose acetate formed fabric should be used. But possible are also any closed support, such as for example the paper already cited. The compound structures obtained in each case can be advantageously molded and/or structured for regulating its thickness.

A special advantage of the process according to the invention lies in the fact that the targeted melt-blown formed fabric can be produced without requiring special additive substances, such as for example any auxiliary processing agents.

Based on its properties, the melt-blown formed fabric according to the invention is suited especially advantageously as filter material. The formed fabric, for example in tobacco smoke filters, in particular in cigarette filters, and especially in double filters for ultralight cigarettes, is used for the filtration of gases and liquids, such as for example sterile filtration of beverages as well as especially advantageously for the filtration of blood.

If the melt-blown formed fabric according to the invention is used in cigarette filters, these are readily disintegratable. Furthermore, a low degree of substitution DS of the cellulose ester, in particular of the cellulose acetate, leads to especially favorable biological degradability.

The filter materials according to the invention not only show a better filter effect than the materials known so far, they also meet without restriction the taste requirements. This applies in particular to cellulose acetate in connection with a residual content of triacetin softening agent.

In the following the invention will be explained in further detail in conjunction with examples.

EXAMPLE 1

Cellulose acetate having a DP of 220 and a DS of 2.5 was placed by means of a gravimetric dosing device into the charging opening of the first zone of a parallel twin-screw laboratory extruder with a screw diameter of 25 mm, a length of 48 D and 15 zones. In the second zone triacetin was supplied as the softening agent at a ratio of 2:3 (1:1.5) by means of a reciprocating piston pump. The temperature in zones 1 and 2 were 30° C., in the third zone the temperature was 110° C., in the fourth zone it was 150° C. The temperature of zones 5 to 11 was 150° C. and of zones 12 to 15 it was 175° C. At a screw speed of 150 RPM a homogeneous melt was obtained. The melt obtained was converted via a round section die continuously into a strand and the latter was cooled below the melting temperature and reduced with the aid of a strand granulator into cylindrical granulates of 2 mm diameter and 3 mm length. The granulate obtained was supplied to a melt-blown laboratory spinning device comprising an extruder, intermediate block, melt tube, spinning head spinneret, hot-air device, stacker and winder. The temperature in the extruder of the melt-blown laboratory spinning device was increased from 100° C. at the inlet to 170° C. at the extruder outlet. The intermediate block and the melt tube were set to 200° C. The temperature in the spinning head was 230° C. The air temperature was 265° C. The quantity of air was adjusted to 70 $m^3$/h. At these process parameters a melt pressure of 125 bars developed. The weight throughput was 7.7 kg/h. The fibers generated with the spinning device were deposited on a receiving belt and continuously drawn off under the spinning device such that a weight per unit area of 132 g/$m^2$ was obtained. By means of a wind-up device the formed fabric was wound to form a roll. The roll of formed fabric was subsequently supplied to a washing device filled with water comprising two successive vats and the softening agent comprised in the formed fabric was rinsed out to a remaining content of 0.3%. The formed fabric was subsequently dried with a drying unit at 160° C. up to a residual moisture content of 4.8%. The mean fiber diameter of the formed fabric obtained thus was 8.4 $\mu$m. The reflection factor (R∞), relative to the barium sulfate white standard, was 65%.

EXAMPLE 2

Cellulose acetate with a DP of 220 and a DS of 2.5 was placed by means of a gravimetric dosing device into the charging opening of the first zone of a parallel twin-screw laboratory extruder with a screw diameter of 25 mm, a length of 48 D and 15 zones. In the third zone triacetin was added as the softening agent at a ratio of 3:2 (1.5:1) by means of a reciprocating piston pump. The temperature in the first and second zone was 50° C., in the third 100° C. and in the fourth zone 120° C. The temperature of zones 5 to 10 was 140° C. and of zones 11 to 15 it was 150° C. The weight throughput was 3.2 kg/h. At a screw speed of 190 RPM, a homogeneous melt was obtained. The melt obtained was supplied directly to a laboratory belt-blown spinning device described under Example 1, which, however, in contrast to Example 1, no longer required an extruder since the material to be processed was already present in the form of a melt. In this case the melt-blown spinning unit followed immediately the parallel twin-screw laboratory extruder. The intermediate block and the melt tube were set to 170° C. The temperature in the spinning head spinneret was 210° C. Air temperature was 255° C. The air quantity was adjusted to 60 $m^3$/h. At these process parameters a melt pressure of only 73 bars developed. The fibers generated with the spinning device were deposited on a receiving belt and drawn off continuously under the spinning device such that a weight per unit area of 176 g/$m^2$ resulted. The formed fabric obtained in this way was conducted directly into a washing device described as in Example 1, and the softening agent contained in the formed fabric was rinsed out to leave a residual content of 5.5%. The formed fabric was subsequently dried with a drying arrangement at 150° C. to allow a residual moisture content of 6.3%. The mean fiber diameter of the formed fabric obtained was 5.7 $\mu$m. The reflection factor (R∞), relative to the barium sulfate white standards, was 74%.

What is claimed is:

1. A melt-blown formed fabric based on cellulose acetate having a degree of polymerization between about 150 to 400, said formed fabric having fibers with a mean fiber diameter in the range of about 2 to 8 $\mu$m, a retained softening agent following extraction of nearly 0 to 10% of the weight of formed fabric, a reflection factor (R∞), determined according to DIN 53 145 Part I (1992), of more than approximately 60%, and a degree of substitution of approximately 1.7 to 2.7.

2. The fabric according to claim 1 wherein the said softening agent is extractable with water.

3. The fabric according to claim 1 wherein said softening agent is a member selected from the group consisting of triacetin, ethylene and propylene carbonate, triethyl citrate, triethylene glycol diacetate, polyethylene glycol with weight of 200–1400 and tetrahydrothiophene 1,1-dioxide.

4. The fabric according to claim 1 wherein the degree of substitution DS is about 2.2 to 2.6.

5. The fabric according to claim 1 wherein said cellulose acetate has a degree of polymerization DP of approximately 180 to 350.

6. The fabric according to claim 1 wherein the content of said softening agent is 2 to 8 weight percent.

7. The fabric according to claim 1 wherein the reflection factor (Roo) is greater than about 70%.

8. The fabric according to claim 1 wherein the cellulose acetate is a polymer blend with a member selected from the group consisting of aliphatic polyesters, acetylated starches and mixtures thereof.

9. The method of preparing a filter material which consists of preparing a melt-blown formed fabric according to claim 1.

10. The method according to claim 9 wherein said filter material is applied in tobacco smoke filters.

11. The method according to claim 10 wherein said filter material is applied in double filters for ultralight cigarettes.

12. The method according to claim 9 wherein said fabric is applied as a filter of bases or liquids.

13. The method according to claim 12 wherein said fabric is applied as a filtering material for blood.

14. A process for the production of a melt-blown formed fabric as claimed in claim 1 wherein the cellulose acetate has a degree of substitution DS of approximately 1.7 to 2.7 and a degree of polymerization between about 150 to 400, the process comprises the steps of:

a) mixing said cellulose acetate with a softening agent at a ratio by weight of approximately 2:1 to 1:4 of said cellulose acetate to said softening agent while being heated and converted into a melt, wherein the mixture of softening agent and cellulose acetate has a melt index MFI (210/2.16) according to DIN 53 735 of approximately 400 to 5 g/10 min;

b) processing the melt in a melt-blown spinning device to form a melt-blown formed fabric; and c) extracting the softening agent with a solvent in which the softening agent is soluble, to leave a fraction thereof of approximately 0 to 10% of the weight of the formed fabric.

15. The process according to claim 14 wherein step b) is carried out in the presence of air at a temperature of 255°–265° C. and a pressure of 60 $m^3$/h–70 $m^3$/h.

16. The process according to claim 14 wherein the ratio by weight of said softening agent to said cellulose acetate is adjusted to approximately 3:2 to 2:3.

17. The process according to claim 14 wherein the temperature in step a) is adjusted to approximately 140 to 180° C.

18. The process according to claim 14 wherein the spinning device has a spinning head and a spinneret and the temperature at the spinning head and the spinneret is adjusted in step b) to approximately 180 to 240° C.

19. The process according to claim 14 wherein the mixing of said cellulose acetate and softening agent in step a) takes place in a parallel twin-screw extruder.

20. The process according to claim 14 wherein in step c) the softening agent is extracted with water.

21. The process according to claim 20 wherein the melt-blown formed fabric after step b) is transferred to a water bath for the extraction of the softening agent.

22. The process according to claim 21 wherein the formed fabric leaving the melt-blown spinning device after step b) is transported to a stacking arrangement, pressed to adjust the desired thickness and is subsequently in step c) subjected to extraction.

23. The process according to claim 22 wherein the melt-blown formed fabric is deposited on a stacking arrangement which is a screen, a traveling screen or a revolving screen.

24. The process according to claim 14 wherein in the formation of the melt-blown formed fabric, filaments of cellulose acetate are added in step a).

25. The process according to claim 14 wherein the melt-blown formed fabric after step b) leaving the spinning device is deposited on a base for the formation of a compound structure.

26. The process according to claim 25 wherein the base is a formed fabric of a cellulose acetate filter tow, a flat filter tow or paper.

27. The process according to claim 25 wherein said compound structure is subjected to at least one pressure and structuring for the purpose of regulating its thickness.

* * * * *